US007901253B2

(12) United States Patent
Yudate

(10) Patent No.: US 7,901,253 B2
(45) Date of Patent: Mar. 8, 2011

(54) MULTICONDUCTOR JACK AND MULTICONDUCTOR PLUG

(75) Inventor: Shinya Yudate, Matsuyama (JP)

(73) Assignee: EX Company Limited, Matsuyama-shi, Ehime-ken (JP)

( * ) Notice: Subject to any disclaimer, the term of this patent is extended or adjusted under 35 U.S.C. 154(b) by 0 days.

(21) Appl. No.: 12/665,113

(22) PCT Filed: Jun. 20, 2008

(86) PCT No.: PCT/JP2008/001607

§ 371 (c)(1),
(2), (4) Date: Dec. 17, 2009

(87) PCT Pub. No.: WO2008/155921

PCT Pub. Date: Dec. 24, 2008

(65) Prior Publication Data

US 2010/0197172 A1 Aug. 5, 2010

(30) Foreign Application Priority Data

Jun. 20, 2007 (JP) ..... 2007-162134

(51) Int. Cl.
*H01R 24/04* (2006.01)

(52) U.S. Cl. ..... 439/669; 439/63

(58) Field of Classification Search ..... 439/63, 439/668, 669

See application file for complete search history.

(56) References Cited

U.S. PATENT DOCUMENTS 6,461,199 B1 * 10/2002 Koga et al. ..... 439/668
6,595,804 B2 * 7/2003 Nagata ..... 439/668
7,316,589 B1 * 1/2008 Rogers et al. ..... 439/668
7,500,882 B2 * 3/2009 Goetz et al. ..... 439/669
2002/0052148 A1 5/2002 Nagata
2010/0197172 A1 * 8/2010 Yudate ..... 439/669

FOREIGN PATENT DOCUMENTS

JP 1992-25823 Y2 6/1992
JP 2002-134237 A 5/2002

OTHER PUBLICATIONS

International Search Report (ISR) in International Application No. PCT/JP2008/001607 of present national stage application, which was published as WO 2008/155921 A1 (Japanese and English versions), Jul. 15, 2008.

Office Action received in Japanese Patent Application No. 2007-162134, to which present application claims priority, Dec. 17, 2009.

English-language summary of JP 1992-25823 Y2, Jun. 22, 1992.

* cited by examiner

*Primary Examiner* — James Harvey

(74) *Attorney, Agent, or Firm* — JTT Patent Services, LLC; Gerald T. Peters

(57) ABSTRACT

A multiconductor plug (10) has exposed electrodes (11*a* through 11*e*) on a shaft portion (14) and an electrode (11*f*) located at an annular flat portion of a flange portion (15) perpendicular to an axial direction. A multiconductor jack (20) has a casing (21) forming a space capable of being occupied by the shaft portion (14) of the multiconductor plug (10), electrically conductive terminals (23*a* through 23*e*) that come into electrically conductive contact with the electrodes (11*a* through 11*e*) of the shaft portion (14) of the multiconductor plug (10), and an electrically conductive terminal (23*f*) having a contacting portion (23*f*1) for making electrically conductive contact with the flat electrode (11*f*) perpendicular to the axial direction and an elastic portion (23*f*3) that extends in the axial direction. The contacting portion (23*f*1) of the electrically conductive terminal (23*f*) presses against the electrode (11*f*) as a result of elastic forces parallel to the axial direction.

4 Claims, 8 Drawing Sheets

MULTICONDUCTOR JACK AND MULTICONDUCTOR PLUG

TECHNICAL FIELD

The present invention relates to a jack and a plug serving as electric connectors for carrying out electrically conductive connection, and more particularly, to a multiconductor jack and a multiconductor plug.

BACKGROUND ART

Many multiconductor plugs having three or four electrodes have conventionally been provided as plugs for use with portable music players, for example. However, because portable music players have in recent years come to be equipped with a great many functions, and also because of the need to provide multifunctional remote control capability and so forth, there is demand for further increase in the number of electrodes.

To meet such demand, Patent References Nos. 1 through 4, below, disclose multiconductor plugs and multiconductor jacks having five or more electrodes.

Patent Reference No. 1: Japanese Utility Model Registration No. 2545747

Patent Reference No. 2: Japanese Registered Utility Model No. 3078619

Patent Reference No. 3: Japanese Patent No. 3569658

Patent Reference No. 4: Japanese Unexamined Patent Application Publication No. 2002-134237

The multiconductor plugs disclosed in Patent Reference Nos. 1 through 4 achieve increased number of electrodes by more finely subdividing the surface of the post in the axial direction to increase the number of electrodes, providing an electrode at the tip of the post, or providing electrodes on the interior and exterior surfaces of the cylindrical portion (plug cover) disposed peripherally about the base portion of the post.

DISCLOSURE OF INVENTION

Problem to be Solved by the Invention

However, there being a limit to the amount by which the number of electrodes can be increased by more finely subdividing the post in the axial direction, further increase in electrode number cannot be expected. Furthermore, when attempting to provide electrodes on the interior and exterior surfaces of the plug cover, there has been the problem that this increases the diameter of the jack, making the structure complicated. Consequently, there is demand for a novel method of achieving increased number of electrodes that is different from the conventional methods of increasing the number of electrodes.

The present invention has been devised to solve the above problems, it being an object of the present invention to provide a multiconductor jack and a multiconductor plug that achieves an increased number of electrodes by a novel method.

Means for Solving the Problems

To solve the above problems, a multiconductor jack in accordance with the present invention is a multiconductor jack for connection to a multiconductor plug having an exposed electrode on a shaft portion and a flat electrode perpendicular to an axial direction, the multiconductor jack being characterized in that it comprises: a casing forming a space capable of being occupied by the shaft portion of the multiconductor plug; a first electrically conductive terminal having a contacting portion that faces the space and comes into electrically conductive contact with the electrode on the shaft portion of the multiconductor plug; and a second electrically conductive terminal having an elastic portion that extends in the axial direction of the multiconductor plug, and a contacting portion that comes into electrically conductive contact with the flat electrode of the multiconductor plug.

Furthermore, a multiconductor plug in accordance with the present invention is a multiconductor plug having a rod-shaped shaft portion for insertion in a multiconductor jack and a cylindrical flange portion provided at a base of the shaft portion, the multiconductor plug being characterized in that an annular flat electrode perpendicular to the axial direction of the shaft portion is formed at a tip side of the flange portion.

EFFECT OF THE INVENTION

Multiconductor jacks and multiconductor plugs in accordance with the present invention make it possible by a novel method to provide multiconductor jacks and multiconductor plugs having an increased number of electrodes.

BEST MODES FOR CARRYING OUT THE INVENTION

With reference to the drawings, embodiments of the present invention will be described in detail below. The present embodiment will be described in detail by way of the example of a six-electrode, single-headed plug and jack (ϕ 3.5). First, with reference to FIGS. 1 and 2, the configuration of a multiconductor plug according to the present embodiment will be described. FIG. 1 is a perspective view of a multiconductor plug according to the present embodiment, and FIG. 2 is a sectional perspective view of the multiconductor plug according to the present embodiment.

As shown in FIGS. 1 and 2, a multiconductor plug 10 comprises first through sixth electrodes 11*a* through 11*f* made of an electrically conductive metal, insulating collars 12*a* through 12*d* made of an insulating material for achieving isolation between the respective electrodes 11, and a spacer 13. Furthermore, these electrodes 11, insulating collars 12, and spacer 13 form a rod-shaped shaft portion 14, this being the portion that is inserted in the jack, and a cylindrical flange portion 15 that is disposed at the base of the shaft portion 14.

The rod-shaped first electrode (tip) 11*a* is disposed centrally in the shaft portion 14, being exposed at the surface of the shaft portion 14 at the tip of the first electrode 11*a*, and is in electrically conductive contact with a terminal of the jack, with the exposed portion serving as contacting portion. A cylindrical second electrode (ring) 11*b* is disposed exterior to the first electrode 11*a*, with an insulating collar 12*a* serving as insulating layer being interposed therebetween. Similarly, disposed in order as one proceeds toward the exterior of the shaft portion 14 there are: an insulating collar 12*b*, a third electrode (ring) 11*c*, an insulating collar 12*c*, a fourth electrode (ring) 11*d*, an insulating collar 12*d*, and a fifth electrode (ring) 11*e*.

Furthermore, on the surface of the shaft portion 14, exposed in order as one proceeds from the tip toward the base there are: the first electrode 11*a*, the insulating collar 12*a*, the second electrode 11*b*, the insulating collar 12*b*, the third electrode 11*c*, the insulating collar 12*c*, the fourth electrode

11*d*, the insulating collar 12*d*, and the fifth electrode 11*e*, these five electrodes being formed just by the shaft portion 14 that is inserted in the jack.

Thus, although a plurality of electrodes are arranged in order in the axial direction of the shaft portion 14 in a manner similar to that which existed conventionally, in accordance with a novel method for increasing the number of electrodes the present embodiment is characterized in that the sixth electrode 11*f* is formed on a flat surface perpendicular to the axial direction on the tip side of the flange portion 15.

The flange portion 15 is formed by the cylindrical spacer 13, which serves as an insulating layer provided exterior to the fifth electrode 11*e*, and the cylindrical sixth electrode 11*f*, which is arranged so as to cover the outer periphery of the spacer 13. The sixth electrode 11*f* has an annular flat surface perpendicular to the axial direction at the tip side of the flange portion 15. When the plug is inserted in the jack, the annular flat electrode serves as a contacting portion which comes in contact with a terminal of the jack.

The width of this annulus of the sixth electrode 11*f* is set to 1.65 mm in the present embodiment. By thus giving the annular flat surface a certain amount of width, it is possible to reliably achieve electrically conductive contact with the electrically conductive terminal of the multiconductor jack, described below. A width of at least 0.5 mm at the annulus will permit achievement of satisfactory electrically conductive contact, and a width of at least 1.0 mm at the annulus will permit achievement of even more satisfactory electrically conductive contact. Note that since excessive width will cause the size of the plug and the jack to become too large, it is preferred that this width not exceed 3 mm.

Moreover, the portions exposed to the surface on the side opposite the shaft portion 14 serving as the first through fifth electrodes act as leads for those respective electrodes, and the portion on the side opposite the annular flat surface serving as the sixth electrode acts as a lead.

Next, referring to FIGS. 3 and 4, the configuration of the multiconductor jack according to the present embodiment will be described. FIG. 3 is a perspective view of a multiconductor jack according to the present embodiment. FIG. 4 is a perspective view, with hidden lines partially visible, of the multiconductor jack according to the present embodiment.

As shown in FIGS. 3 and 4, a multiconductor jack 20 has an insulating casing 21 made of a synthetic resin, and first through sixth electrically conductive terminals 23*a* through 23*f* disposed in predetermined places in the casing 21 so as to make electrically conductive contact with the electrodes 11 of the multiconductor plug 10. The electrically conductive terminals 23 are made of electrically conductive metal. The electrically conductive terminals 23 are formed in such shapes as will cause them to press against the electrodes 11 due to elastic forces when the plug and the jack are connected to each other.

Specifically, when the multiconductor plug 10 is not inserted therein, the contacting portions of the electrically conductive terminals 23*a* through 23*e* are disposed such that they project somewhat into the space that will be occupied by the shaft portion 14 of the multiconductor plug 10. When the multiconductor plug 10 is inserted therein, the contacting portions of the electrically conductive terminals 23*a* through 23*e* are pushed back by the electrodes 11*a* through 11*e* and are deformed, thereby generating elastic forces and causing the contacting portions to press against the electrodes 11*a* through 11*e*.

The contacting portion 23$f_1$ of the sixth electrically conductive terminal 23*f* projects somewhat, not into the aforementioned space that will be occupied by the shaft portion 14, but into an exterior region at a plug insertion port 21*a* of the casing 21. When the multiconductor plug 10 is inserted in the jack, the annular flat surface portion of the flange portion 15 will be disposed at a location where this contacting portion 23$f_1$ protrudes, which will cause the contacting portion 23$f_1$ to be pressed back and elastic forces to be generated, causing the contacting portion 23$f_1$ to press against the sixth electrode 11*f*. When the contacting portions of the electrically conductive terminals 23 are made to press against the electrodes 11 of the plug in this manner, electrically conductive contact can be maintained satisfactorily even in the event that external forces are applied to the plug and/or jack.

Here, the directions of the pressing forces that act between the first through fifth electrodes 11*a* through 11*e* located on the shaft portion 14 and the contacting portions of the first through fifth electrically conductive terminals 23*a* through 23*e* which face the space that will be occupied by the shaft portion 14 are perpendicular to the insertion direction (axial direction) of the multiconductor plug as was the case conventionally, but the direction of the pressing force that acts between the sixth electrode 11*f* and the contacting portion 23$f_1$ of the sixth electrically conductive terminal 23*f* is parallel to the insertion direction of the multiconductor plug 10.

As shown in FIG. 4, the sixth electrically conductive terminal 23*f* is arranged so as to extend in the insertion direction along the side face of the casing 20 in a region exterior to the second electrically conductive terminal 23*b* and the fourth electrically conductive terminal 23*d*. One end of the sixth electrically conductive terminal 23*f*, this being the tip end, is the contacting portion 23$f_1$ that comes in contact with the sixth electrode 11*f*, while the other end, this being the base end, is fixed to the casing 21 and serves as a lead segment 23$f_2$.

The sixth electrically conductive terminal 23*f* has an elastic portion 23$f_3$ (accordion-like structure) that is wave-like in shape, peaks and valleys being arranged in alternating fashion in the insertion direction of the plug. Consequently, the sixth electrically conductive terminal 23*f* acts as an elastic member capable of extension and contraction in the insertion direction of the plug, with the lead segment 23$f_2$ side acting as fixed end. Accordingly, when the multiconductor plug 10 is inserted in the multiconductor jack 20, the contacting portion 23$f_1$ is pushed back by the annular flat surface portion of the sixth electrode 11*f*. Elastic forces generated by the accordion-like structure cause the contacting portion 23$f_1$ to press against the sixth electrode 11*f*, permitting electrically conductive contact to be maintained satisfactorily.

Such a sixth electrically conductive terminal might be formed by using a press die in a stamping operation to form electrically conductive sheet metal into a shape containing the wave-like structure, following which the contacting portion 23$f_1$ might be formed by folding over a region in the vicinity of the tip at the contacting portion 23$f_1$ side, and the lead segment 23$f_2$ might be formed by folding a predetermined location at the base side. In addition, to make the contacting portion 23$f_1$ and the sixth electrode 11*f* come into point contact with each other, the contacting portion 23$f_1$ might be bent, following which the bent portion might further be made curved so that the contacting tip is formed in a convex shape. Forming the contacting portion 23$f_1$ in a convex shape as described above will cause it to come into point contact with the electrode 11, permitting stabilization of electrically conductive contact and achievement of a cleaning effect.

Such an electrically conductive terminal in which elastic forces are generated parallel to the axial direction of the plug facilitates electrode terminal layout design, since layout locations do not interfere with conventional electrically conductive terminals generating elastic forces in directions perpendicular to the axis, and makes it possible to provide multiconductor jacks having simple structures that occupy small volumes.

Next, the situation that exists when the multiconductor plug 10 is inserted in the multiconductor jack 20 will be described. FIG. 5 is a sectional perspective view showing the situation that exists when the multiconductor plug and the multiconductor jack are connected to each other. In the situation that exists when the multiconductor plug 10 is inserted in the multiconductor jack 20 as shown in FIG. 5, the first electrode 11*a* is in contact with the first electrically conductive terminal 23*a*, the second electrode 11*b* is in contact with the second electrically conductive terminal 23*b*, the third electrode 11*c* is in contact with the third electrically conductive terminal 23*c*, the fourth electrode 11*d* is in contact with the fourth electrically conductive terminal 23*d*, and the fifth electrode 11*e* is in contact with the fifth electrically conductive terminal 23*e*. At this time, as a result of insertion of the multiconductor plug 10, the contacting portions of the electrically conductive terminals 23 are pushed back in directions perpendicular to the insertion direction, and the contacting portions of the electrically conductive terminals 23 press against the electrodes 11 in directions perpendicular to the axial direction of the multiconductor plug 10.

Furthermore, annular flat surface at the tip of the sixth electrode 11*f* provided on the flange portion 15 of the multiconductor plug 10 is in contact with the sixth electrically conductive terminal 23*f*. At this time, the direction of contact between the sixth electrode 11*f* and the sixth electrically conductive terminal 23*f* is parallel to the axial direction of the plug, and the sixth electrically conductive terminal 23*f*, which has the above-described structure, is capable of extension and contraction in a direction parallel to the insertion direction of the plug, as a result of which elastic forces are generated in a direction parallel to the insertion direction of the plug.

Moreover, because the respective electrodes 11 according to the present embodiment are cylindrical in shape, having electrically conductive contacting surfaces in 360° with the electrically conductive terminals 23 of the jack, permitting electrically conductive contact to be achieved regardless of what rotational position the multiconductor plug 10 is in when it is inserted in the multiconductor jack 20 and permitting electrically conductive contact to be maintained despite any rotation of the multiconductor plug 10 relative to the multiconductor jack 20 following insertion.

As described in detail above, a multiconductor plug and a multiconductor jack in accordance with the present embodiment permit provision of a novel method for increasing the number of electrodes. Furthermore, by adopting a configuration such as that of the present embodiment, in which the sixth electrically conductive terminal 23*f* is made to extend and contract in a direction parallel to the insertion direction of the plug, causing generation of elastic forces, because the direction of extension and contraction is different from that of the other electrically conductive terminals 23, this increases the degrees of freedom with which the sixth electrically conductive terminal 23*f* can be arranged and makes it possible to easily design the structure of the multiconductor jack.

Next, a variation on the present embodiment will be described with reference to the drawings. The present variation is characterized in that it is a multiconductor jack 30 of a water-resistant type. FIG. 6 is a perspective view of the multiconductor jack according to the present variation. FIG. 7 is a perspective view, with hidden lines partially visible, of the multiconductor jack according to the present variation. FIG. 8 is a rear-side perspective view of the multiconductor jack according to the present variation.

While the multiconductor jack 30 according to the present variation is characterized in that it is of water-resistant design, since the basic structure and function are similar to those of the multiconductor jack 20 of the foregoing embodiment, description will be omitted with respect to structure that is identical, description being confined instead to structure that is peculiar to the present variation.

As shown in FIGS. 6 through 8, the multiconductor jack 30 according to the present variation has a casing 31 made of a synthetic resin, a seal 32, and electrically conductive terminals 33*a* through 33*f* for making electrically conductive contact with the electrodes of the plug. Imaginary lines in FIG. 6 indicate a mounting panel 50 in which the multiconductor jack 30 is inserted.

The seal 32 is a ring made of rubber that is arranged so as to be disposed peripherally about the jack insertion port of the casing 31 in a region interior to the contacting portion of the electrically conductive terminal 33*f* which projects outside the casing 31. The seal 32 is sandwiched between the mounting panel 50 and the casing 31 when the multiconductor jack 30 is mounted to the mounting panel 50, thereby increasing airtightness and ensuring water-resistance of the multiconductor jack 30.

As shown in FIGS. 7 and 8, all of the lead segments of the electrically conductive terminals 33*a* through 33*f* are guided from the rear face of the casing 31 to the exterior. Mounted on the rear face of the casing 31 is a rear cover 34 having notches in portions corresponding to the leads. Adhesive is applied to this rear cover 34, thereby ensuring that the jack interior will be water-resistant.

While embodiments of the present invention including variations thereon have been described above in detail, modes of carrying out the present invention are not limited to the foregoing embodiments, a great many variations being possible within the gist of the present invention. For example, the number of electrodes of the multiconductor jack and the multiconductor plug is not limited to six, it being possible to employ four, five, seven, or any other suitable number of electrodes so long as there are a plurality thereof.

Furthermore, although a planar flat surface has been employed as the flat electrode (sixth electrode) perpendicular to the axial direction in the present embodiment, it goes without saying that this is not limited only to perfectly planar flat surfaces, it being possible to achieve satisfactory contact with the electrically conductive terminal even with gently curved surfaces. Therefore, where the present specification refers to flat electrodes, this should be understood to include electrodes having gently curved surfaces.

EXPLANATION OF REFERENCE NUMERALS

Figure 1:
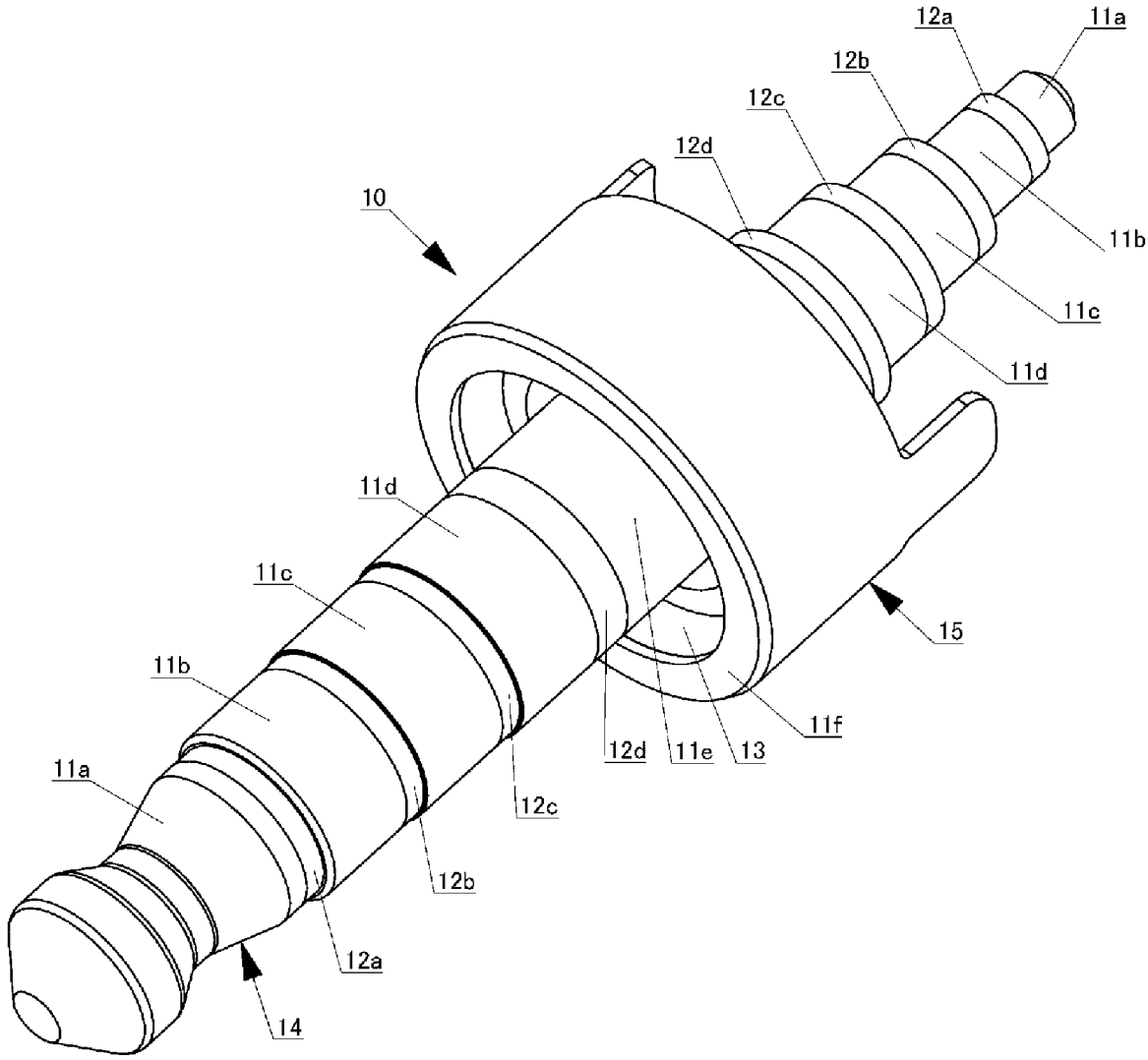
FIG. 1 is a perspective view of a multiconductor plug according to the present embodiment.
Figure 2:
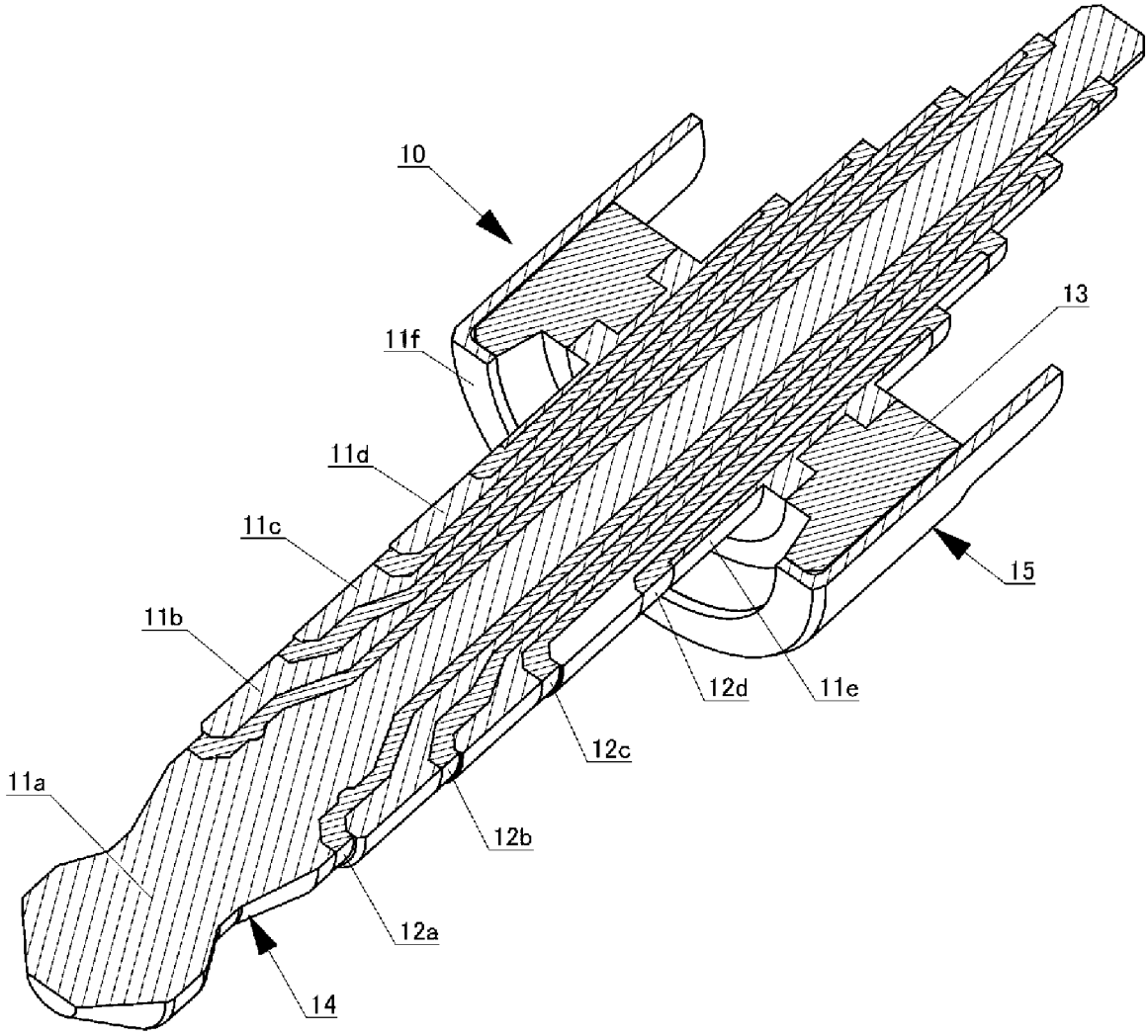
FIG. 2 is a sectional perspective view of the multiconductor plug according to the present embodiment.
Figure 3:
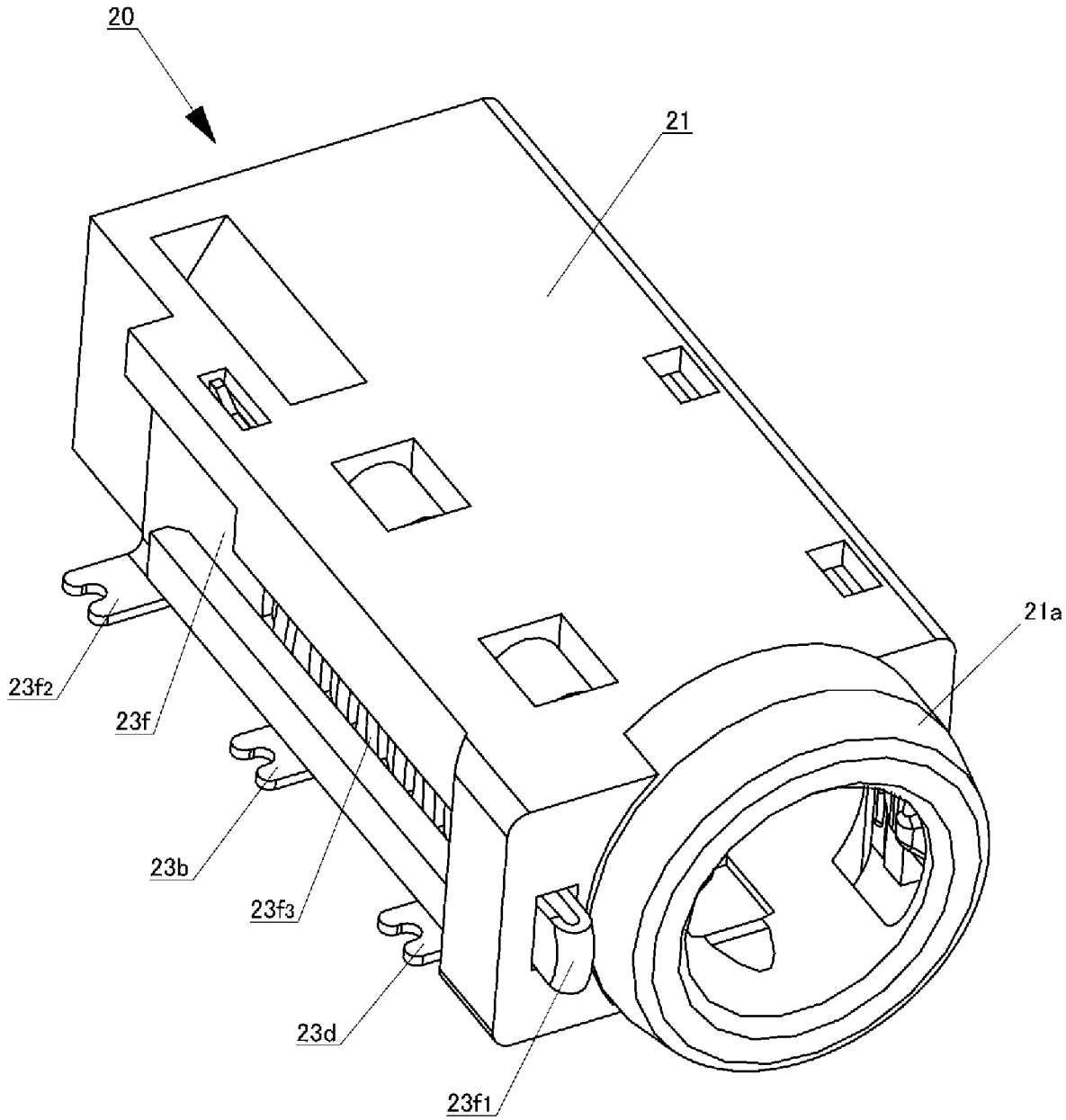
FIG. 3 is a perspective view of a multiconductor jack according to the present embodiment.
Figure 4:
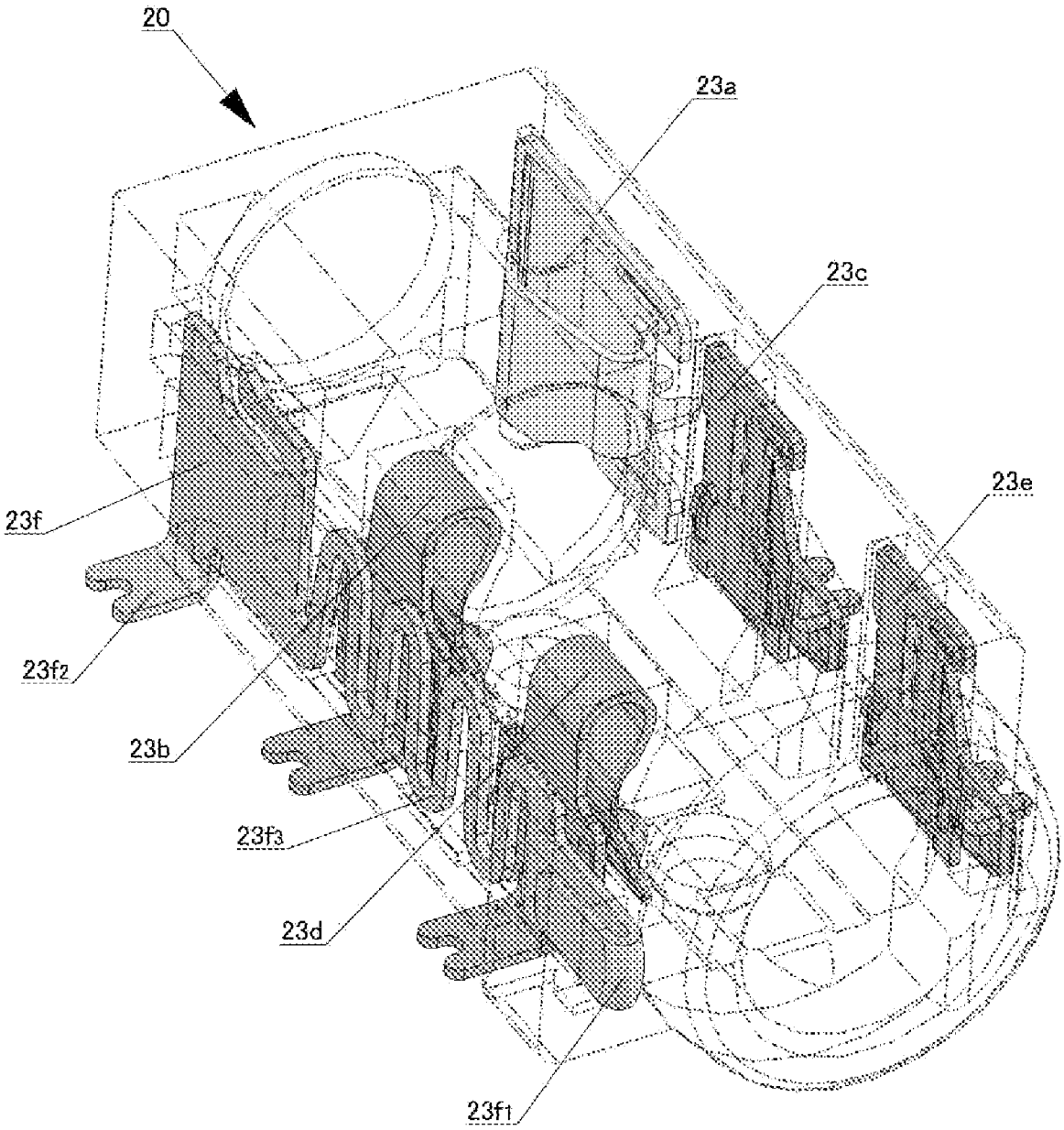
FIG. 4 is a perspective view, with hidden lines partially visible, of the multiconductor jack according to the present embodiment.
Figure 5:
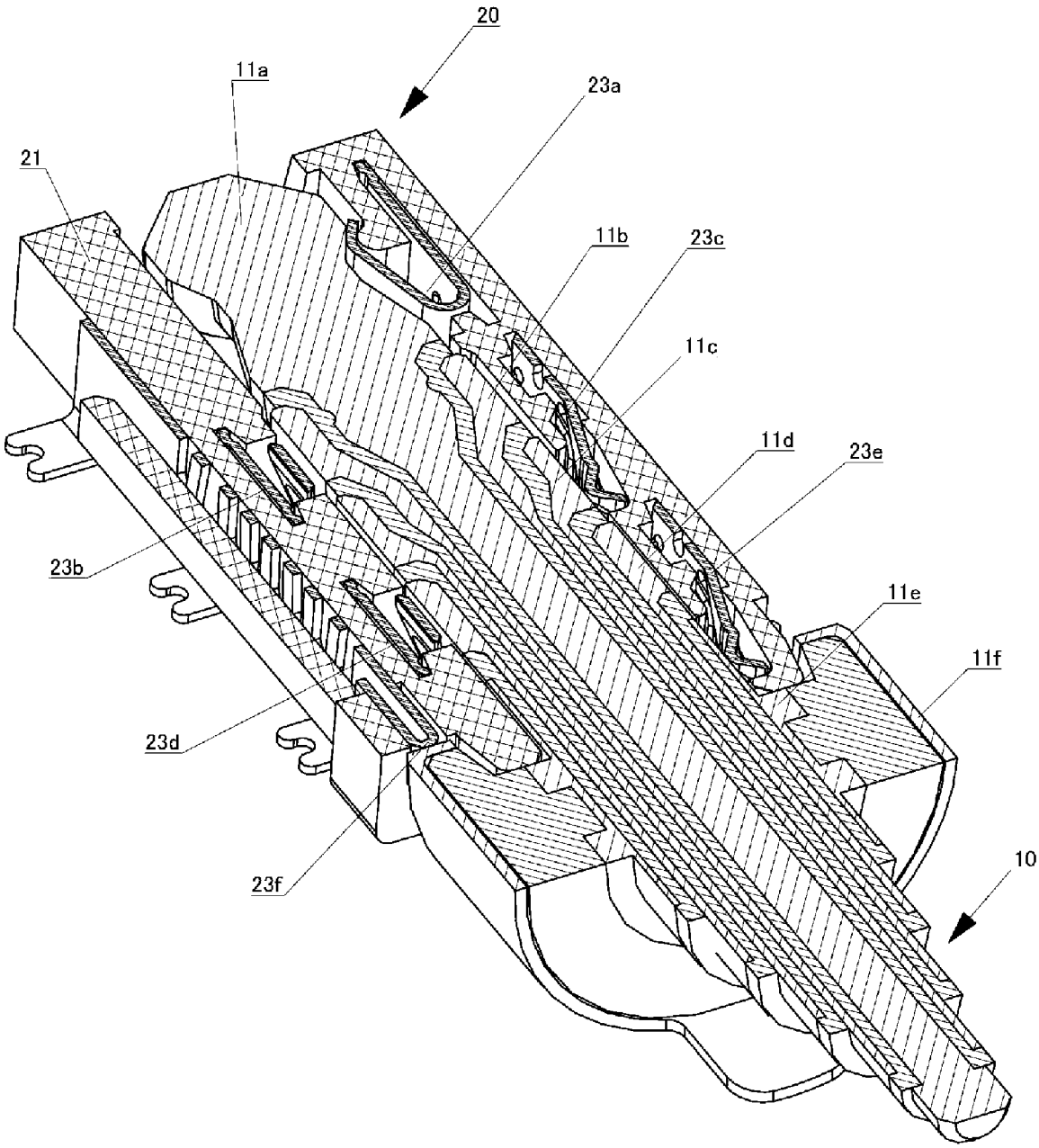
FIG. 5 is a sectional perspective view of a situation that exists when the multiconductor plug and the multiconductor jack according to the present embodiment are connected to each other.
Figure 6:
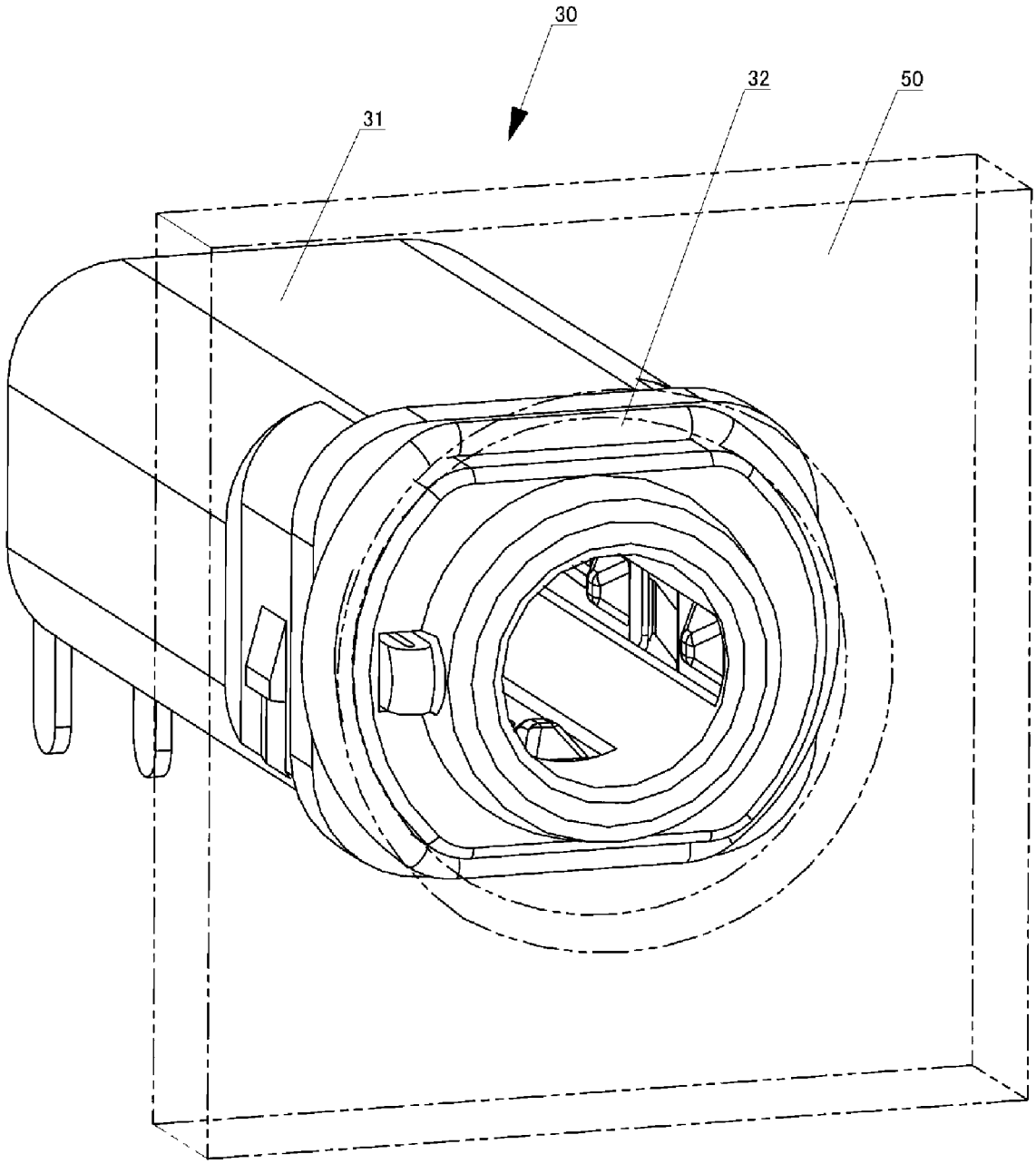
FIG. 6 is a perspective view of a multiconductor jack according to a variation on the present embodiment.
Figure 7:
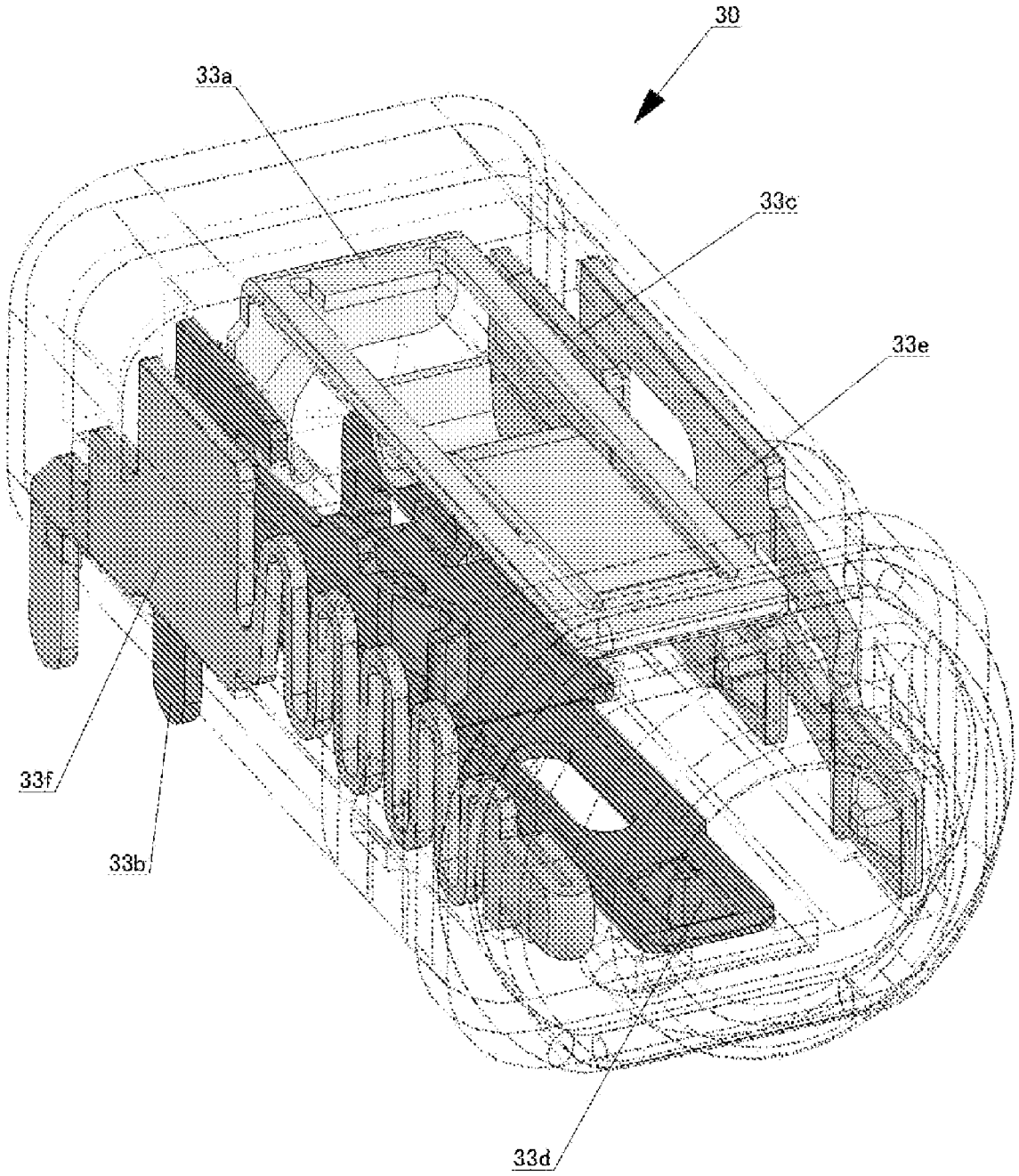
FIG. 7 is a perspective view, with hidden lines partially visible, of the multiconductor jack according to the variation on the present embodiment.
Figure 8:
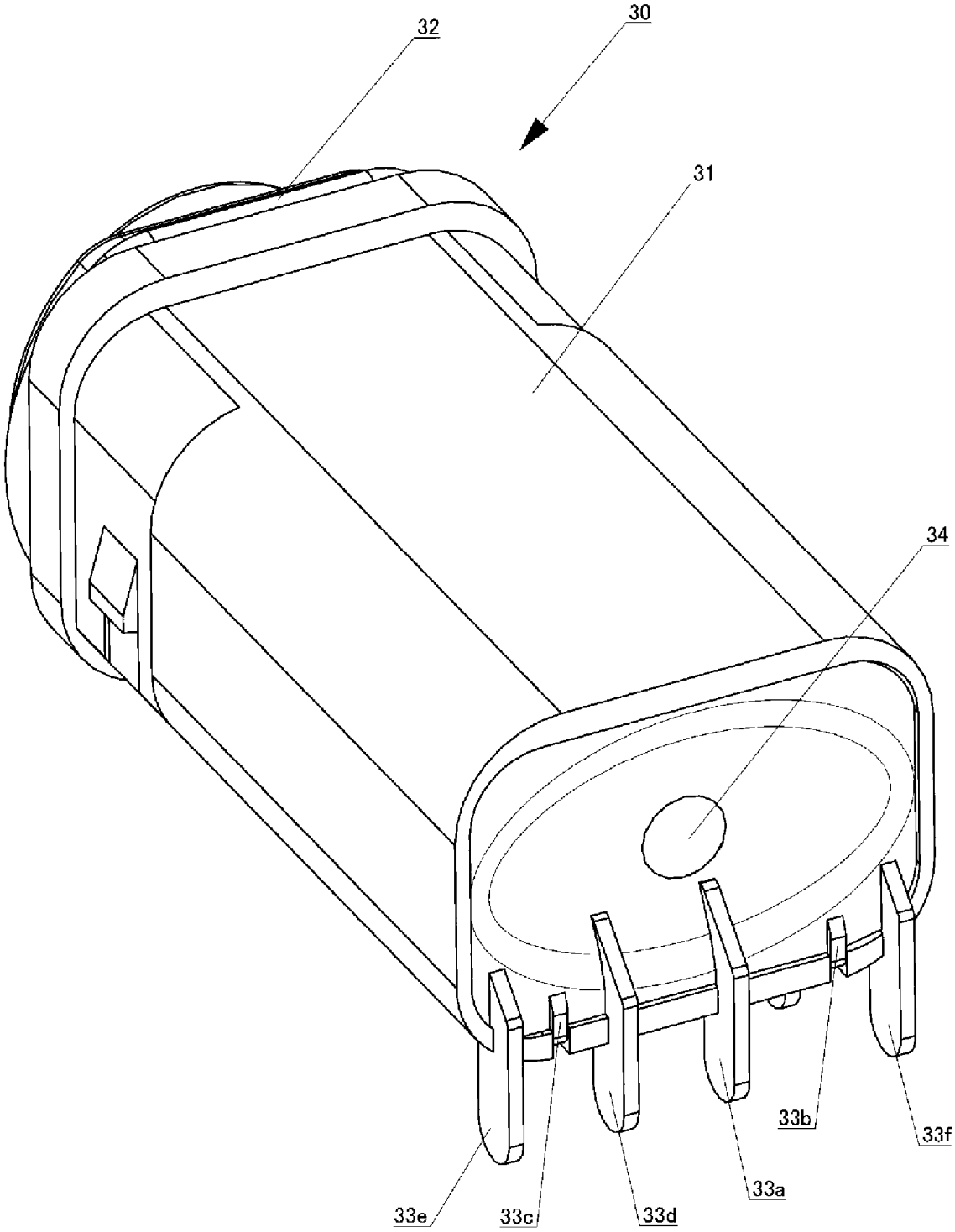
FIG. 8 is a rear-side perspective view of the multiconductor jack according to the variation on the present embodiment.

10 Multiconductor plug
11 Electrode
12 Insulating collar
13 Spacer
14 Shaft portion
15 Flange portion
20 Multiconductor jack
21 Casing
23 Electrically conductive terminal
30 Multiconductor jack
31 Casing
32 Seal
33 Electrically conductive terminal
34 Rear cover

The invention claimed is:

1. A multiconductor jack for connection to a multiconductor plug having an exposed electrode on a shaft portion and a flat electrode perpendicular to an axial direction, the multiconductor jack being characterized in that it comprises:

a casing forming a space capable of being occupied by the shaft portion of the multiconductor plug;

a first electrically conductive terminal having a contacting portion that faces the space and comes into electrically conductive contact with the electrode on the shaft portion of the multiconductor plug; and a second electrically conductive terminal having an elastic portion that extends in the axial direction of the multiconductor plug, and a contacting portion that comes into electrically conductive contact with the flat electrode of the multiconductor plug.

2. A multiconductor jack according to claim 1 characterized in that the contacting portion of the second electrically conductive terminal is arranged so as to protrude from the casing in a region peripheral to an inlet opening into the space capable of being occupied by the shaft portion of the multiconductor plug, and is constituted so as to be pushed back in the axial direction by the flat electrode, being pressed against the flat electrode by elastic forces generated by the elastic portion, when the multiconductor plug is inserted therein.

3. The multiconductor plug for connection to the multiconductor jack according to claim 1, wherein:

the shaft portion is a rod-shaped shaft portion capable of being inserted into the casing of the multiconductor jack; and a cylindrical flange portion is provided at a base of the shaft portion;

wherein, when the multiconductor plug is connected to the multiconductor jack, the electrode present on the shaft portion of the multiconductor plug is capable of coming into electrically conductive contact with the first electrically conductive terminal of the multiconductor jack; and the flat electrode is an annular flat electrode perpendicular to the axial direction of the shaft portion that is formed at a tip side of the flange portion of the multiconductor plug, the annular flat electrode being capable of coming into electrically conductive contact with the second electrically conductive terminal of the multiconductor jack.

4. The multiconductor plug according to claim 3 characterized in that a width of an annulus of the annular flat electrode is not less than 0.5 mm.

* * * * *